US009003578B2

(12) United States Patent
Hillenbrand, II

(10) Patent No.: US 9,003,578 B2
(45) **Date of Patent: *Apr. 14, 2015**

(54) PATIENT POSITIONING DEVICE

(71) Applicant: William A. Hillenbrand, II, Batesville, IN (US)

(72) Inventor: William A. Hillenbrand, II, Batesville, IN (US)

(73) Assignee: Hillenbrand Management Company LLC, Batesville, IN (US)

( * ) Notice: Subject to any disclaimer, the term of this patent is extended or adjusted under 35 U.S.C. 154(b) by 89 days.

This patent is subject to a terminal disclaimer.

(21) Appl. No.: 13/632,561

(22) Filed: Oct. 1, 2012

(65) Prior Publication Data

US 2014/0090167 A1 Apr. 3, 2014

Related U.S. Application Data

(63) Continuation of application No. 13/341,315, filed on Dec. 30, 2011, now Pat. No. 8,453,276, and a continuation of application No. 12/581,251, filed on Oct. 19, 2009, now Pat. No. 8,087,109.

(60) Provisional application No. 61/215,379, filed on May 5, 2009.

(51) Int. Cl.
*A61G 7/14* (2006.01)
*A61G 7/10* (2006.01)

(52) U.S. Cl.
CPC ..... *A61G 7/1026* (2013.01); *A61G 7/1032* (2013.01)

(58) Field of Classification Search
CPC .. A61G 7/1026; A61G 7/1032; A61G 7/1034
USPC ..... 5/81.1 R, 81.1 C, 81.1 HS, 488
See application file for complete search history.

(56) References Cited

U.S. PATENT DOCUMENTS

| | | | |
|---|---|---|---|
| 3,383,717 | A | 5/1968 | Underwood |
| 3,466,679 | A | 9/1969 | Hess |
| 3,597,774 | A | 8/1971 | Warren |
| 3,962,736 | A | 6/1976 | Fedele |
| 4,181,992 | A | 1/1980 | Blake |
| 4,776,047 | A | 10/1988 | DiMatteo |
| 4,799,273 | A | 1/1989 | Elze |
| 4,819,283 | A | 4/1989 | DiMatteo et al. |
| 4,926,513 | A | 5/1990 | Oats |
| 4,939,798 | A | 7/1990 | Last |

(Continued)

OTHER PUBLICATIONS

International Search Authority/United States, Notification of Transmittal of the International Search Report and The Written Opinion of the International Searching Authority, or the Declaration, issued in PCT Application No. PCT/US2014/055821, dated Dec. 22, 2015.

*Primary Examiner* — Michael Trettel
(74) *Attorney, Agent, or Firm* — Wood, Herron & Evans, LLP

(57) ABSTRACT

A patient positioning device for restoring a patient to a desired position in a hospital bed. An example patient positioning device may include a flexible track positioned along each of the lateral edges of a sleep surface and extending substantially the entire length of the sleep surface, a sheet including beaded edges for slidably engaging the tracks such that the sheet spans between the first track and the second track on the sleep surface, and/or a drive mechanism located proximate a head end of the sleep surface and configured to pull the sheet towards the head end of the bed.

29 Claims, 11 Drawing Sheets

(56) References Cited

U.S. PATENT DOCUMENTS

| | | | |
|---|---|---|---|
| 4,941,220 | A | 7/1990 | DiMatteo et al. |
| 5,020,171 | A | 6/1991 | DiMatteo et al. |
| 5,185,894 | A | 2/1993 | Bastert et al. |
| 5,718,009 | A | 2/1998 | Lin |
| 6,289,533 | B1 | 9/2001 | Hodgetts |
| 6,363,555 | B1 | 4/2002 | LaRose |
| 6,615,423 | B2 | 9/2003 | Sverdlik et al. |
| 6,772,456 | B2 | 8/2004 | Votel |
| 7,111,338 | B2 | 9/2006 | Faux et al. |
| 7,191,479 | B1 | 3/2007 | Cheng |
| 7,293,303 | B2 | 11/2007 | Worrell |
| 7,305,725 | B2 | 12/2007 | Burton |
| 7,337,478 | B1 | 3/2008 | Lake |
| 7,487,558 | B2 | 2/2009 | Risk, Jr. et al. |
| 8,087,109 | B2 | 1/2012 | Hillenbrand, II |
| 8,453,276 | B2 * | 6/2013 | Hillenbrand, II ..... 5/81.1 HS |
| 2005/0217023 | A1 | 10/2005 | Tally |
| 2013/0025048 | A1 | 1/2013 | Pruett |

* cited by examiner

PATIENT POSITIONING DEVICE

CROSS REFERENCE TO RELATED APPLICATION

The application is a continuation of U.S. Nonprovisional patent application Ser. No. 13/341,315, filed Dec. 30, 2011, now U.S. Pat. No. 8,453,276, which was a continuation of U.S. Nonprovisional patent application Ser. No. 12/581,251, filed Oct. 19, 2009, now U.S. Pat. No. 8,087,109, which claimed priority from U.S. Provisional Application No. 61/215,379, filed May 5, 2009, the contents of each of which are incorporated herein by reference.

BACKGROUND

The present disclosure is directed to patient positioning devices and, more particularly, to devices for repositioning patients in hospital beds.

U.S. Pat. Nos. 4,776,047; 5,185,894; 6,289,533; and 7,293,303 describe patient movement devices and are incorporated by reference into this background section.

SUMMARY

Exemplary embodiments include a patient positioning device for restoring a patient to a desired position in a hospital bed. An example patient positioning device may include a flexible track positioned along each of the lateral edges of a sleep surface and extending substantially the entire length of the sleep surface, a sheet including beaded edges for slidably engaging the tracks such that the sheet spans between the first track and the second track on the sleep surface, and/or a drive mechanism located proximate a head end of the sleep surface and configured to pull the sheet towards the head end of the bed.

In an aspect, a patient positioning device for a hospital bed may include a first track positioned proximate a first lateral edge of the sleep surface and extending substantially a length of the sleep surface, the first track being flexible; a second track position proximate a second lateral edge of a sleep surface, the second lateral edge being opposite from the first lateral edge, the second track extending substantially the length of the sleep surface, the second track being flexible; a sheet including a first beaded edge slidably engaging the first track and a second beaded edge slidably engaging the second track such that the sheet spans between the first track and the second track on the sleep surface; and a drive mechanism located proximate a head end of the sleep surface and configured to receive a leading edge of the sheet. The drive mechanism may be selectively operable to move the sheet towards the head of the bed.

In a detailed embodiment, the first track and the second track may be integrated with the sleep surface.

In a detailed embodiment, the first track and the second track may be mounted to at least one of the sleep surface and a bed frame associated with the sleep surface. In a detailed embodiment, the first track and the second track may be mounted to respective extensions reaching at least partially around respective side walls of the sleep surface. In a detailed embodiment, each of the first track and the second track may be mounted to a respective flexible web.

In a detailed embodiment, each of the first track and the second track may include a plurality segments flexibly joined together. In a detailed embodiment, each of the plurality of segments may be constructed of a substantially rigid material.

In a detailed embodiment, each of the first track and the second track may be constructed of a substantially flexible material. In a detailed embodiment, each of the first track and the second track may be flexible in a direction generally towards the other of the first track and the second track. In a detailed embodiment, each of the first track and the second track may be flexible in a direction generally into the sleep surface.

In a detailed embodiment, each of the first track and the second track may form a generally C-shaped cross-section. In a detailed embodiment, each of the first track and the second track may include a substantially longitudinal opening through which the sheet extends.

In an aspect, a method of repositioning a patient on a hospital bed may include installing a sheet including a first beaded edge and a second beaded edge onto a sleep surface including a first track positioned proximate a first lateral edge of the sleep surface and extending substantially a length of the sleep surface, the first track being flexible, and a second track position proximate a second lateral edge of a sleep surface, the second lateral edge being opposite from the first lateral edge, the second track extending substantially the length of the sleep surface, the second track being flexible, by slidably engaging the first beaded edge with the first track and by slidably engaging the second beaded edge with the second track; coupling a leading edge of the sheet to a drive mechanism located proximate a head end of the sleep surface; and operating the drive mechanism to move the sheet towards the head end of the sleep surface.

In a detailed embodiment, a method may include, prior to installing the sheet, installing the first track and the second track on the sleep surface by mounting the first track and the second track to respective sidewalls of the sleep surface. In a detailed embodiment, a method may include, prior to installing the sheet, installing the first track and the second track by mounting the first track and the second track to a frame associated with the sleep surface. In a detailed embodiment, a method may include, prior to operating the drive mechanism, adjusting a head elevation angle of the sleep surface. In a detailed embodiment, installing the sheet may include draping the sheet over a roller positioned proximate the head end of the sleep surface and above the drive mechanism.

BRIEF DESCRIPTION OF THE DRAWINGS

The detailed description refers to the following figures in which.

DETAILED DESCRIPTION

Figure 1:
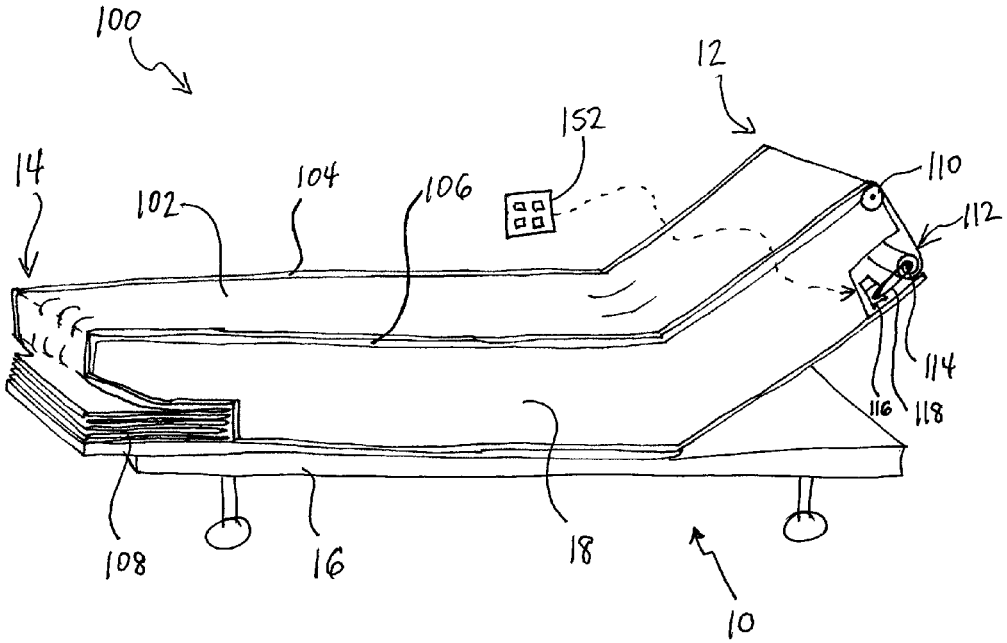
FIG. 1 is a perspective view of an example patient positioning device on a hospital bed.

The present disclosure relates, inter alia, to patient positioning devices which may allow caregivers to reposition patients in hospital beds.

The present disclosure contemplates that a patient lying in a hospital bed may be comfortable when the patient's sacrum is located in the seat section of the bed, the patient has access to controls provided on the bed's side rail, the patient is in close proximity to a bedside cabinet (or other furniture or device), the patient can enjoy over-bed lighting, and/or the patient can access services on the headwall. Such a position may be referred to as a "home" position. In the "home" position, the patient's weight may be distributed throughout the patient's body's contact with the sleep surface (e.g., the mattress or other similar bed component), which may reduce the number and/or severity of pressure points. Accordingly, such a position may reduce the likelihood of the patient developing pressure sores. In some circumstances, the home position may provide the patient with some control of his or her environment, such as by access to controls on bed's side rail.

The present disclosure contemplates that patients lying in a medical bed, especially when the head section of the bed is elevated to improve patient comfort (or for medical reasons), often migrate towards the foot end of the bed, thereby moving away from the home position. Such migration may occur because the head of the bed is elevated and movement of the patient may cause the patient to slide in the direction of the foot end of the bed. Migration may also occur while the head of the bed is in the flat or supine position due to patient self-repositioning to improve comfort.

The present disclosure contemplates that when a patient migrates away from the home position, the patient may lose access to the bed's side rail controls and/or the bedside cabinet, and/or the patient may migrate away from lighting and/or other services provided on the headwall. Also, the patient may experience discomfort as a result of the patient's weight not being distributed over the sleep surface. For example, discomfort may occur due to pressure increases on bony prominences. Further, some conditions of pressure, friction, and/or shear forces due to the patient migrating from the home position may result in the patient developing pressure ulcers and/or other forms of skin compromise. Similarly, the present disclosure contemplates that dragging a patient across a sheet to reposition the patient may cause shear and/or friction, which may increase the probability of the patient developing a pressure ulcer.

The present disclosure contemplates that if a patient migrates away from the home position, a patient with ample strength may pull himself or herself back into the home position without assistance. However, some patients may injure themselves when attempting to pull themselves back into the home position. Some patients may not be willing and/or able to return themselves to the home position. These patients may or may not call for caregiver assistance, and thus may remain out of the home position for an extended period of time.

An example patient positioning device according to the present disclosure may allow a patient who has migrated from the home position to be returned to the home position. Some example patient positioning devices may be integrated with a bed frame of a hospital bed and/or some example patient positioning device may be integrated with the sleep surface. Some example patient positioning devices may be motor-driven such that they may be operated by the patient and/or caregiver activating a controller, such as by pressing a button.

Figure 2:
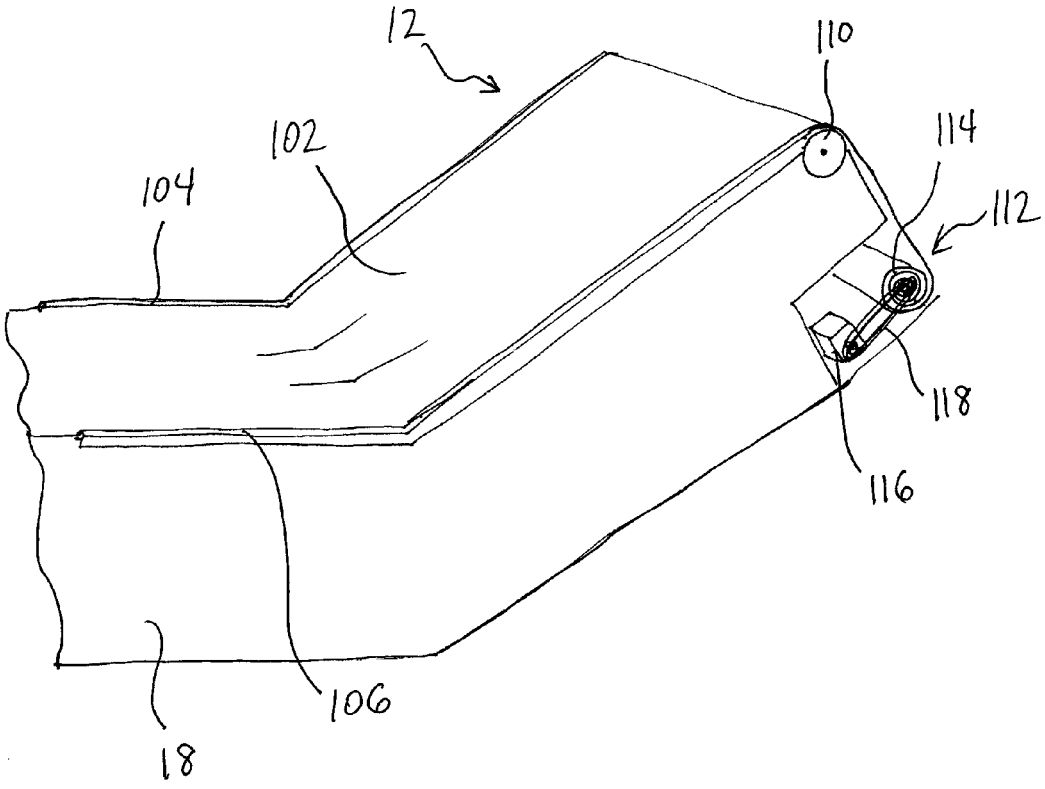
FIG. 2 is a detailed perspective view of a head end of the example patient positioning device of FIG. 1.
Figure 3:
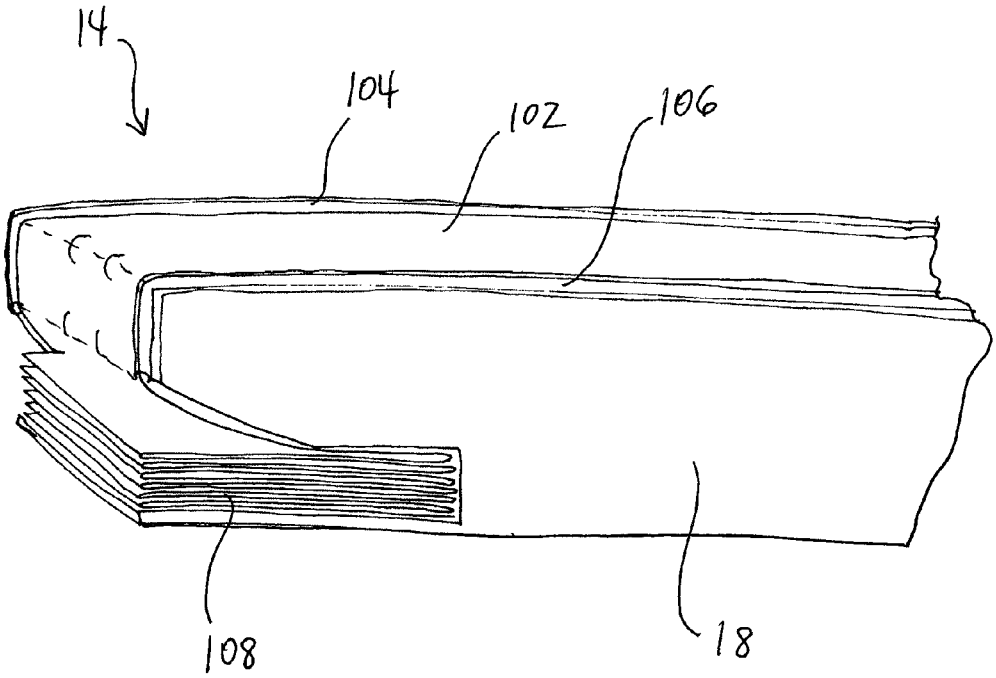
FIG. 3 is a detailed perspective view of a foot end of the example patient positioning device of FIG. 1.

FIGS. 1-3 illustrate an example patient positioning system 100 installed on a hospital bed 10, which may include a frame 16 and/or a sleep surface 18, which may include a head end 12 (which may be elevatable) and/or a foot end 14 (which may be elevatable). An example patient positioning system 100 may include a sheet 102 releasably joined to one or more tracks 104, 106 such that the sheet 102 spans between the tracks 104,106. An example sheet 102 may be provided in a folded stack 108, which may be located near the foot end 14 of the sleep surface 18. The sheet 102 may extend substantially the length of the sleep surface 18 and may pass over a roller 110 proximate the head end 12 of the sleep surface 18. A drive mechanism 112 may be mounted near the head end 12 of the sleep surface 18 and/or may include a sheet drum 114 for receiving the sheet 102, a motor 116 (such as an electric motor) for driving the sheet drum 114, and/or a drive train 118, such as a belt and pulley system. In some example embodiments, drive mechanism 112 may be located under head end 12 of bed 10. In some example embodiments, drive mechanism 112 may be mounted integrally with sleep surface 18.

In some example embodiments, roller 110 may be located near the head end 12 of the bed 10 and/or at or above the plane of sleep surface 18. Sheet 102 may extend over roller 110, which may allow sheet 102 to roll over the edge of the sleep surface 18, thereby reducing friction between sheet 102 and sleep surface 18 when the drive mechanism 112 is activated to wind sheet 102 onto sheet drum 114.

In some example embodiments, tracks 104, 106 may be provided along substantially the entire lateral edge(s) and/or side(s) (e.g., left and/or right top edges) of the sleep surface. The tracks 104, 106 may extend beyond the length of the sleep surface, such as extending downward adjacent the ends of the sleep surface and/or beneath the sleep surface. In some example embodiments, one or more of the tracks 104, 106 may reattach to itself, thereby creating a continuous loop. As discussed below, flexible and or hinged tracks 104, 106 may allow for the articulation of the bed as the head end 12 and/or the foot end 14 are raised and lowered.

In some example embodiments, tracks 104, 106 may retain and/or guide sheet 102, thereby preventing sheet 102 from bunching and wrinkling under the patient, which may be a cause of discomfort and/or pressure sores. Additionally, tracks 104, 106 may prevent objects from being trapped under sheet 102, which may cause discomfort and/or may compromise the patient's skin.

Some example embodiments may include a controller 152 for directing operation of drive mechanism 112. Some example controllers 152 may be mounted to a side rail, a head board and/or a foot board, or other location where it may be readily accessed by the patient and/or caregiver. In some example embodiments, controller 152 may include a stand-alone unit not incorporated into the bed. In some example embodiments, the controller 152 may prevent operation of the drive mechanism 112 unless certain initial conditions are satisfied, such as unless the head end 12 of the bed 10 is lowered below an established elevation angle. This features may reduce shear and friction exerted onto the patient due to the motion of sheet 102 toward the head end 12 of the bed 10. Some example embodiments may include a lock-out function which may prevent operation of the drive mechanism 112. Such a lock-out function may be useful, for example, for patients requiring traction and/or a trapeze and/or for patients who must remain immobile for medical reasons. An example controller 152 may include one or more indicators, such as LED lights, for indicating various conditions. For example, indicators may be provided to indicate that the head elevation angle is at or below an established set point (in an operating range), the head angle is greater than an established set point (out of an operating range), that the lock-out feature is enabled, and/or whether the patient positioning system is on or off.

Figure 4:
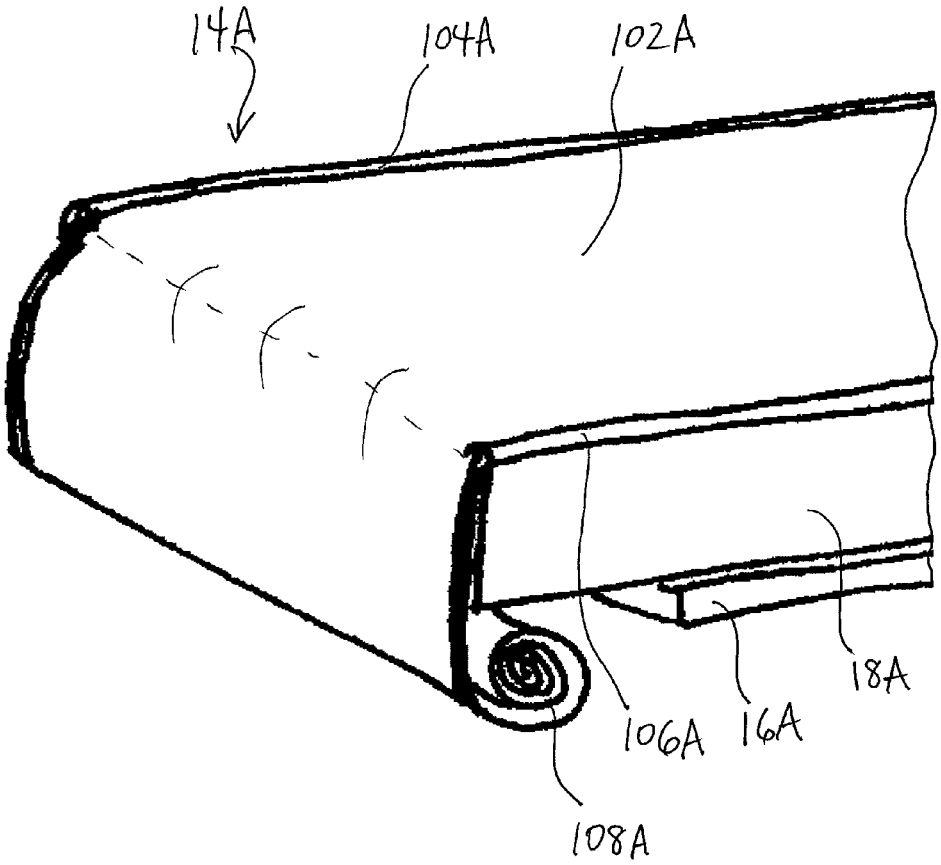
FIG. 4 is a detailed perspective view of an alternative example foot end of a patient positioning device.

FIG. 4 illustrates an alternative example embodiment in which sheet 102A, which may be releasably joined to one or more tracks 104A, 106A on a sleep surface 18A supported by a bed frame 16A, may be supplied in a roll 108A instead of a stack 108.

Figure 5:
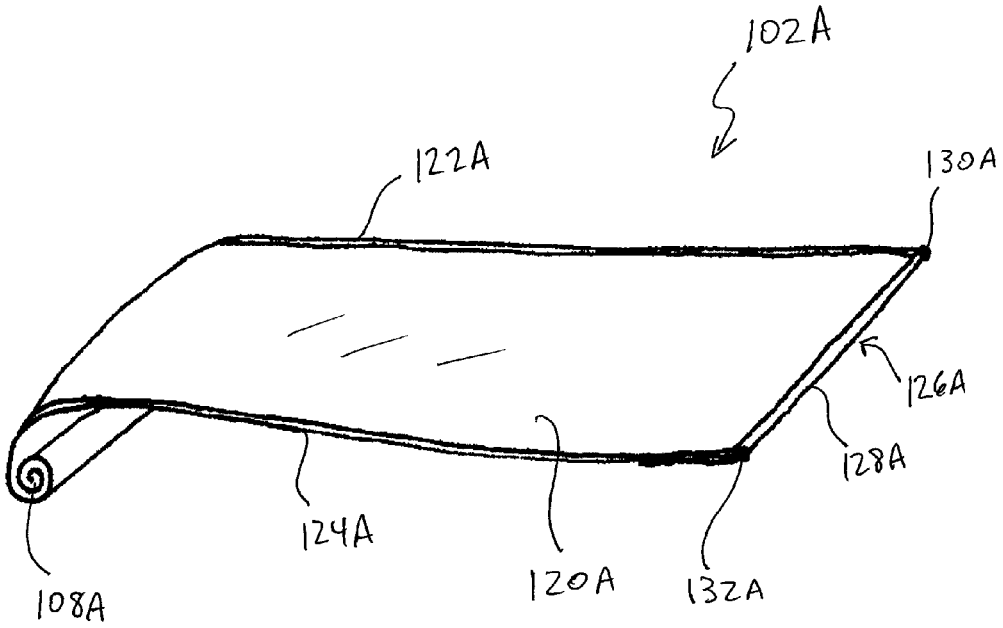
FIG. 5 is a perspective view of an example sheet.
Figure 6:
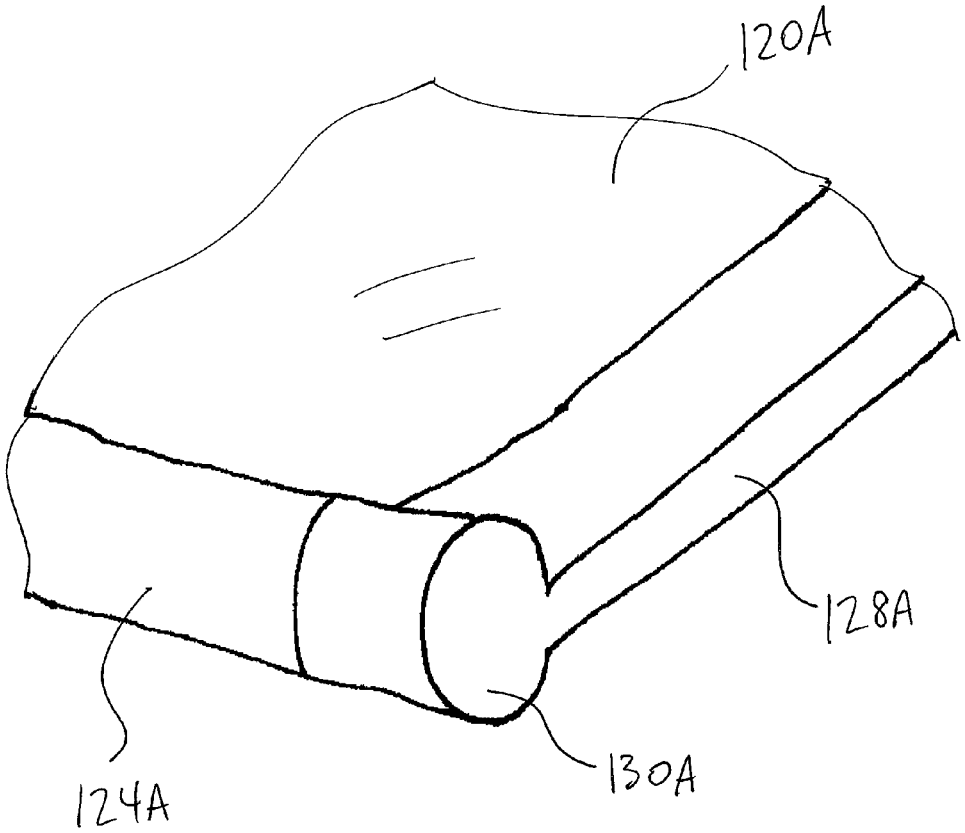
FIG. 6 is a detailed perspective view of a leading edge corner of the example sheet of FIG. 5.

FIGS. 5 and 6 depict an example sheet 102A, which may include sheet material 120A and/or one or more edges configured to interface with tracks 104A, 106A, such as beaded edges 122A, 124A. In some example embodiments, beaded edges 122A, 124A may be substantially continuous for the length of the sheet 102A. In some example embodiments, sheet material 120A may include various materials that may flex and stretch in a variety of directions as are known in the art, such as 2 or 4 way stretch material, Lycra, Spandex and/or Vinyl. In some example embodiments, a leading edge 126A of the sheet 102A may include a sliding element 128A, which may be substantially rigid and/or may substantially span between beaded edges 122A, 124A. Sliding element 128A may include one or more beaded edges 130A, 132A for interfacing with one or more of tracks 104A, 106A. In some example embodiments, sliding element 128A may act as a guide for ease of sliding the sheet 102A into and through tracks 104A, 106A. In some example embodiments, the sliding element 128A may attached the sheet 102A to the sheet drum 114.

Figure 7:
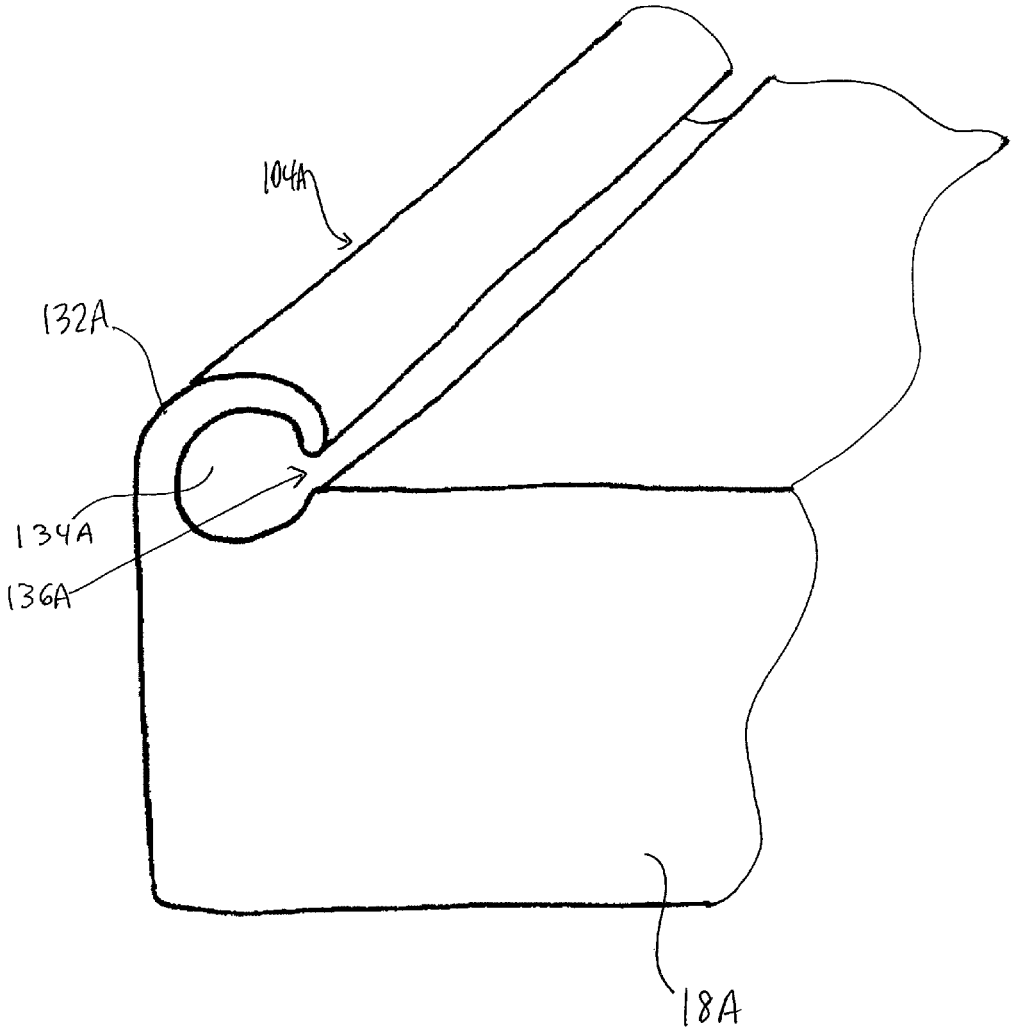
FIG. 7 is a partial cross-sectional view of an example sleep surface including an integrated track.
Figure 8:
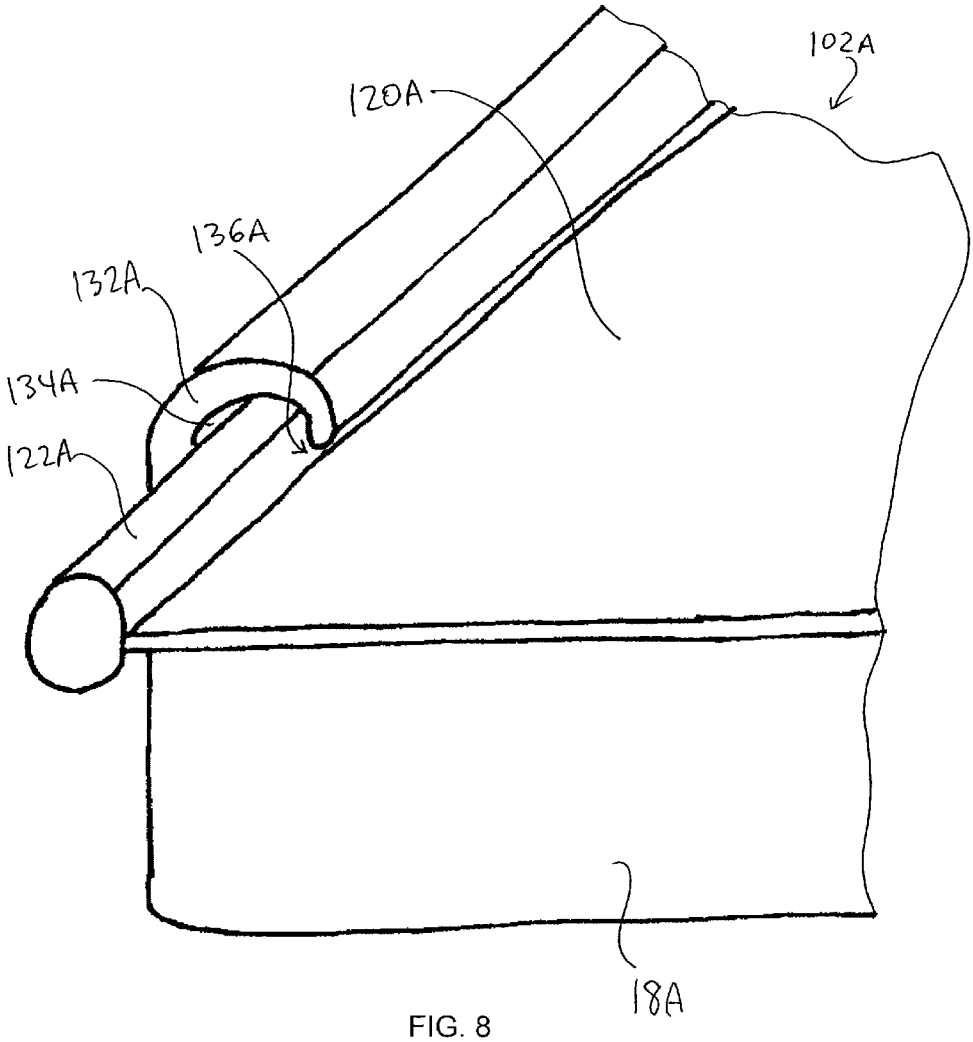
FIG. 8 is a partial cross-sectional view of an example sleep surface including an integrated track with a sheet in place.

FIGS. 7 and 8 illustrate an example track 104A integrated with a sleep surface 18A. An example track 104A may be formed as a channel 132A having a generally C-shaped cross section including a hollow section 134A and a longitudinal opening 136A. As illustrated in FIG. 8, a sleep surface 18A provided with an integrated channel 132A may receive a sheet 102A such that beaded edge 122A is received substantially within the hollow section 134A and sheet material 120A extends from the beaded material through opening 136A.

Figure 9:
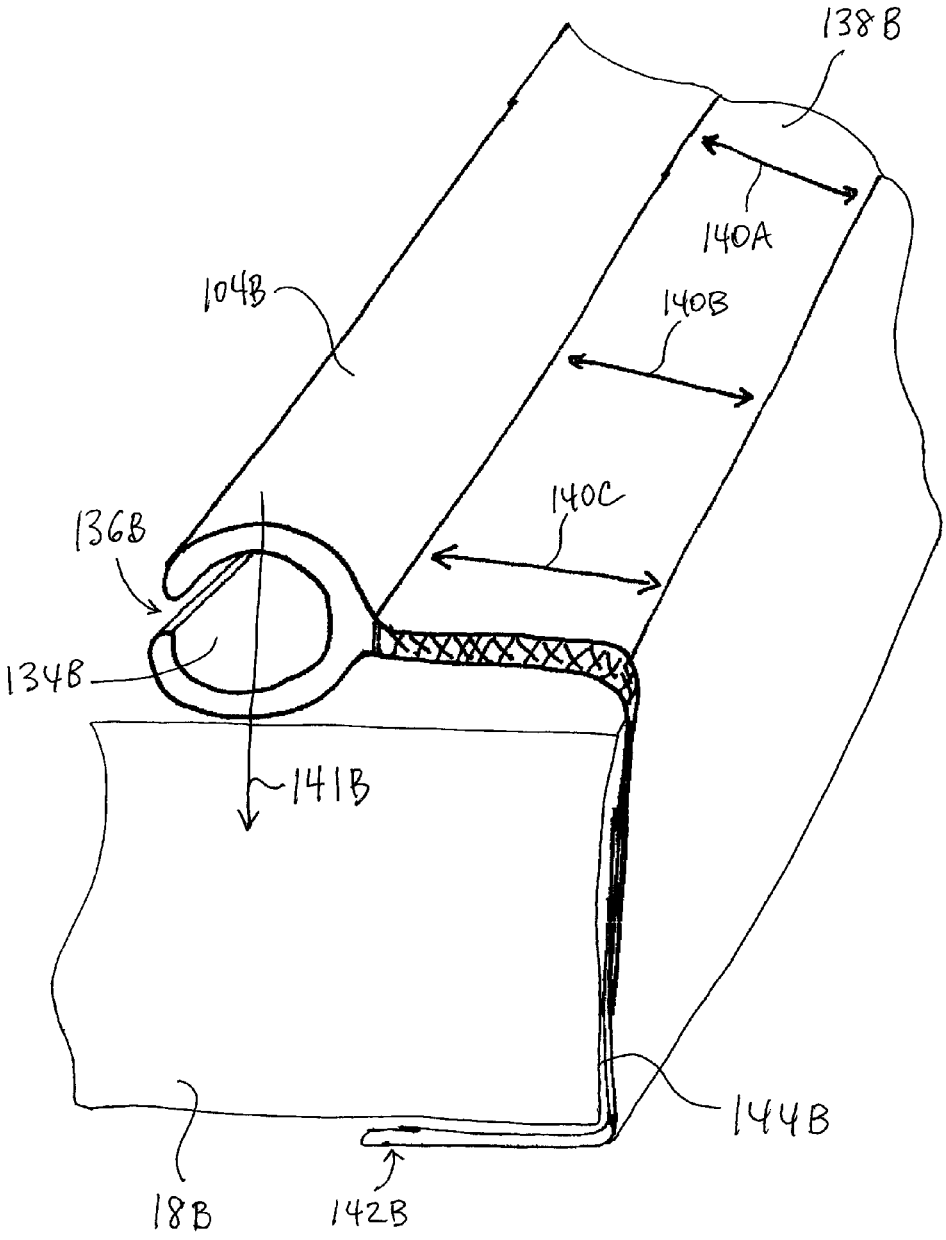
FIG. 9 is a partial cross-sectional view of an example track attached to a sleep surface.
Figure 10:
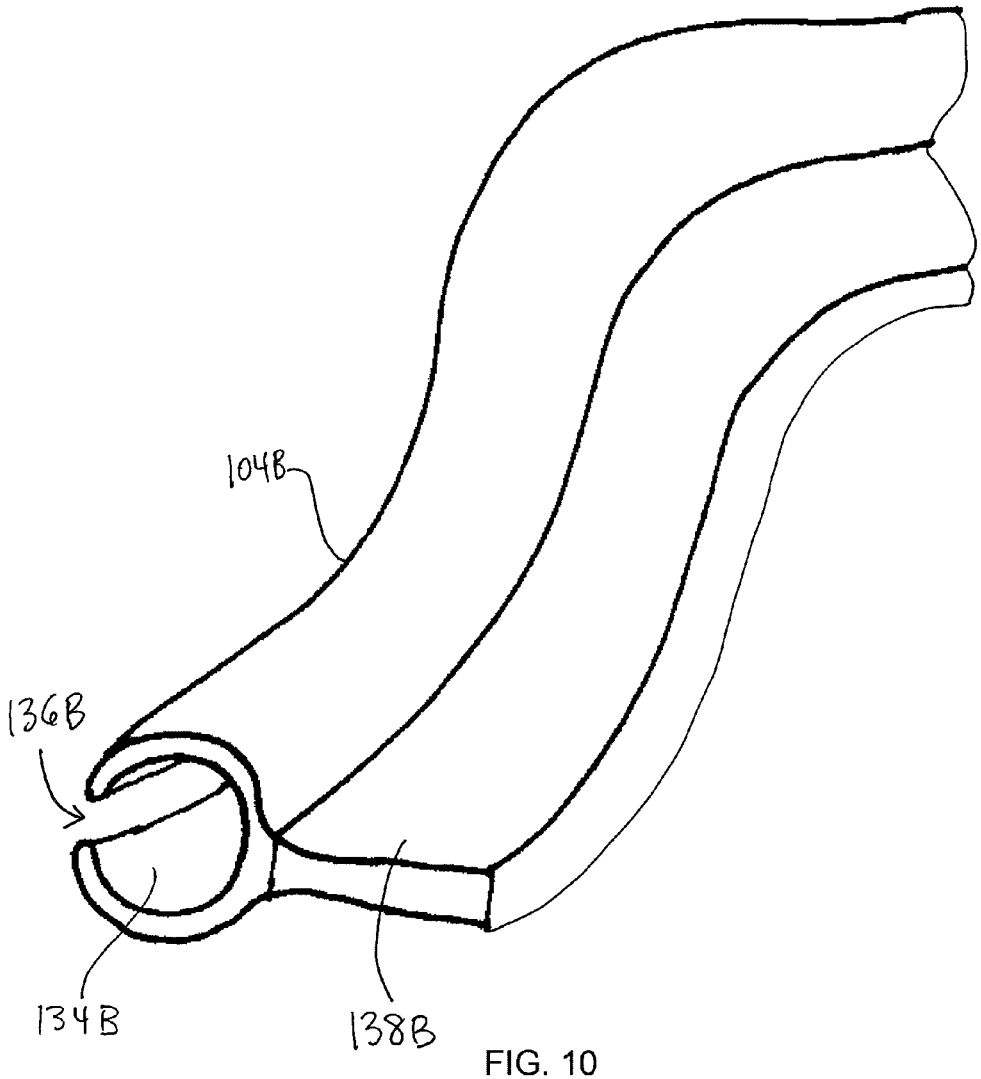
FIG. 10 is a perspective view of an example track.

FIGS. 9 and 10 illustrate an example track 104B which may be mounted to a sleep surface 18B, bed frame 16, and/or other component of an articulating bed, such as a hospital bed. Track 104B may have a generally C-shaped cross-section including a hollow section 134B and/or a longitudinal opening 136B. Track 104B may be mounted using a web 138B, which may be substantially rigid or flexible, and/or substantially inelastic or elastic. While example embodiments may be configured to flex and/or stretch in various directions, some example embodiments may be configured to permit movement of track 104B in at least in the general directions indicated by arrows 140A, 140B, 140C, which may be generally laterally with respect to the sleep surface (e.g., towards the other track). In some embodiments, track 104B may be flexible in a downward direction indicated by arrow 141B (e.g., into the sleep surface 18). In some example embodiments, web 138B may include rubber, spandex, and/or other similar flexible and/or elastic materials known in the art. In some example embodiments, web 138B may be connected to sleep surface 18B, such as by an extension 142B reaching at least partially around a side wall 144B of the sleep surface 18B. In some example embodiments, track 104B may be constructed from a substantially flexible material, such as rubber, plastic, and/or a composite material. In some example embodiments, the tracks 104, 106 may be attached to the frame 16 of the bed and/or may be provided as part of an independent device.

Figure 11:
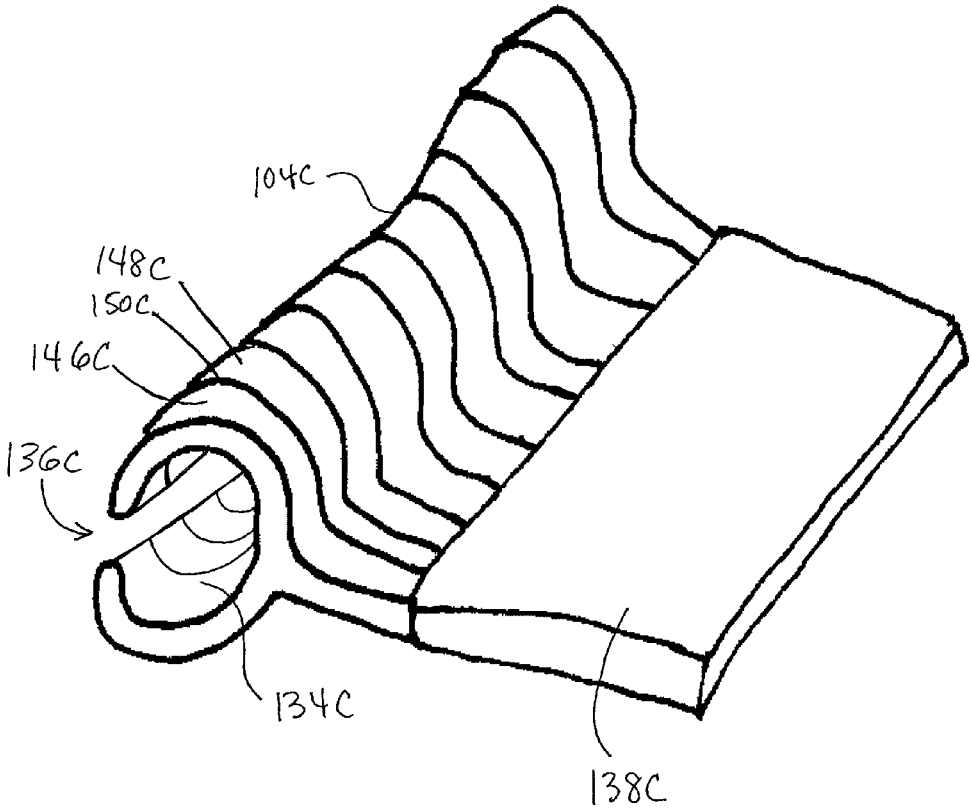
FIG. 11 is a perspective view of an alternative example track; all in accordance with at least some aspects of the present disclosure.

FIG. 11 illustrates an alternative example track 104C, which may be used with any embodiment described herein. Track 104C may include a plurality of segments 146C, 148C which may be interposed by joints 150C, such as hinges and/or pivots. Segments 146C, 148C may form a generally C-shaped track which may include a hollow section 134C and/or a generally longitudinal opening 136C. In some example embodiments, segments 146C, 148C may be constructed of substantially rigid materials, but track 104C may remain flexible because joints 150C may allow some relative motion between the segments 146C, 148C. Segments 146C, 148C may be connected to a web 138C.

The present disclosure contemplates that example embodiments including flexibly and/or elastically mounted sheets (e.g., which may include a web 138B and/or a flexible track 104B, 104C) may improve patient comfort and/or reduce and/or prevent the likelihood of patients developing pressure ulcers. In particular, if a substantially inelastic sheet is inflexibly and/or rigidly coupled to the edges of a sleep surface, the sheet may support some of the patient's weight as the sheet is pressed into the sleep surface and the sheet is tensioned. In other words, the patient may be partially suspended by the tensioned sheet extending between the edges of the sleep surface. If the patient's weight is at least partially supported by the sheet, the effectiveness of the underlying sleep surface may be reduced, particularly if the sleep surface includes features designed to minimize pressure ulcers. For example, some sleep surfaces may include features designed to minimize and/or reduce pressure points and/or vary over time the localized interface pressure between the patient and the sleep surface, and the effectiveness of such features may be reduced if the patient's weight is partially supported by a sheet or other item interposing the patient and the sleep surface. Thus, some example embodiments utilizing a web 1388 and/or a flexible track 1048, 104C and/or flexibly and/or elastically mounted sheets may allow the sheet to move as necessary such that substantially all of a patient's weight may be supported by the sleep surface, rather than the sheet, which may improve patient comfort and/or allow the underlying sleep surface to perform its pressure-reducing/relieving functions.

Some example embodiments may be operated as follows. As discussed above, new or laundered sheet 102, 102A may be provided either in a roll 108A or a folded stack 108. The sheet 102, 102A may be installed proximate the foot end 14 of the bed 10, such as in the sleep surface 18. The sheet 102, 102A may be unraveled by grasping the sliding element 128A which may be incorporated into the leading edge 126A of the sheet 102, 102A and pulling up towards the upper surface of the sleep surface 18. The sliding element 128A may be inserted into the tracks 104, 106 at the left and right sides of the sleep surface 18 at the foot end 14 of the bed 10. The beaded edges 122A, 124A of the sheet 102, 102A may be captured within the opening 134A of the tracks 104A, 106A. The sliding element 128A with attached sheet 102A may be pulled toward the head end 12 of the bed 10. The sliding element 128A and the sheet 102A may be draped over the roller 110 at the head end 12 of the bed 12 and may be attached to the sheet drum 114. When it is desired to reposition the patient towards the head end 12 of the bed 10, the controller 152 may be used to operate the drive mechanism 112. The motor 116 may turn the sheet drum 114, which may wind the sheet 102, 102A onto the sheet drum 114.

In some circumstances, a caregiver may perform one or more actions prior to activating the drive mechanism 112 to reposition the patient. For example, a caregiver may ensure that lines, tubing, hoses, etc. at the head, foot, and/or sides of the bed are free of obstructions and interference and/or a caregiver may raise the side rails of the bed. In some circumstances, a caregiver may adjust the elevation angle of the head end 12 of the bed 10, which may reduce some forces and/or shear experienced by the patient during repositioning. In some circumstances, a caregiver may place the patient in the Trendelenburg position (e.g., a supine, head-down position), such as when repositioning high-risk and/or overweight patients.

Example embodiments may include various combinations of features. For example, an entry level model may utilize standard sheet material, which may provide basic comfort and a protective barrier for the sleep surface. Some example embodiments may include a moisture wicking and heat dissipating material to improve patient comfort and/or clinical outcomes. Some example embodiments may include antimicrobial materials, such as antimicrobial silver nanoparticles.

Some example sheets 102, 102A may be labeled with information such as the owner, a model number, a serial number, and/or a bar code.

While exemplary embodiments have been set forth above for the purpose of disclosure, modifications of the disclosed embodiments as well as other embodiments thereof may occur to those skilled in the art. Accordingly, it is to be understood that the disclosure is not limited to the above precise embodiments and that changes may be made without departing from the scope. Likewise, it is to be understood that it is not necessary to meet any or all of the stated advantages or objects disclosed herein to fall within the scope of the disclosure, since inherent and/or unforeseen advantages may exist even though they may not have been explicitly discussed herein.

What is claimed is:

1. A patient positioning device comprising:

a mattress having at least two ends, wherein at least one end allows vertical and angular repositioning with respect to another end; and, a drive mechanism operatively coupled to the mattress and configured to reposition a sheet along a length of the mattress, the drive mechanism is positioned at least partially below a top surface of the mattress, wherein the drive system is configured to be repositioned when at least one of the two ends of the mattress is repositioned.

2. The patient positioning device of claim 1, wherein the drive mechanism is at least partially positioned within a volume of the mattress.

3. The patient positioning device of claim 1, wherein the drive mechanism is positioned within a volume of the mattress.

4. The patient positioning device of claim 1, wherein the drive mechanism is coupled to the mattress.

5. The patient positioning device of claim 1, wherein the drive mechanism comprises at least two of a roller, a sheet drum, a motor, and a drive train.

6. The patient positioning device of claim 1, wherein the drive mechanism includes a sheet drum and a bearing surface mounted proximate a head end of the mattress, the bearing surface configured to guide the sheet toward the sheet drum.

7. The patient positioning device of claim 6, wherein the bearing surface comprises a rigid structure within a volume of the mattress, wherein the rigid structure is substantially incompressible by the sheet.

8. The patient positioning device of claim 1, wherein the drive mechanism is at least partially positioned within a volume of a sleep surface.

9. The patient positioning device of claim 1, wherein the mattress comprises a portion of a sleep surface that includes a deck configured to be repositionable and reposition the mattress.

10. The patient positioning device of claim 1, further comprising a controller communicatively coupled to the drive mechanism and configured to control the drive mechanism.

11. The patient positioning device of claim 10, wherein the controller includes a user interface including at least one of a plurality of buttons and a plurality of switches.

12. The patient positioning device of claim 10, wherein the controller is located proximate to the drive mechanism.

13. The patient positioning device of claim 10, wherein the controller is mounted to a bed.

14. The patient positioning device of claim 10, wherein the controller is mounted proximate to the mattress.

15. The patient positioning device of claim 10, wherein the controller includes a user interface having a visual display.

16. The patient positioning device of claim 10, wherein the controller is configured to include a lock out function to retard operation of the drive mechanism when at least one of the at least two mattress ends is elevated and angled beyond a predetermined position.

17. The patient positioning device of claim 10, wherein the controller is configured to include a lock out function to retard operation of the drive mechanism.

18. The patient positioning device of claim 10, wherein the controller includes a plurality of light emitting diodes that are selectively illuminated as part of a visual display.

19. The patient positioning device of claim 15, wherein:

the controller is configured to include a lock out function to retard operation of the drive mechanism when at least one of the at least two mattress ends is elevated and angled beyond a predetermined position; and, the visual display includes at least one indicator providing information about at least one of elevation and angle of at least one of the mattress ends, lock out function operability, and operability of the drive mechanism.

20. The patient positioning device of claim 15, wherein:

the controller is user-configured to provide a lock out function to retard operation of the drive mechanism; and, the visual display includes at least one indicator providing information about at least one of operability of the lock out function and operability of the drive mechanism.

21. The patient positioning device of claim 1, further comprising a guide coupled to the mattress and configured to progressively align the sheet along a length of the mattress, wherein the guide is configured to allow traversal of the sheet along the length of the mattress and concurrently retard motion of the sheet in at least two directions perpendicular to the length of the mattress.

22. The patient positioning device of claim 21, wherein the guide is comprised of a plurality of segments.

23. The patient positioning device of claim 21, wherein:

the guide includes a first guide, a second guide, and a third guide; and, the first, second, and third guides are spaced apart from one another an extend along the length of the mattress.

24. The patient positioning device of claim 1, further comprising a guide coupled to the mattress and configured to align the sheet along a length of the mattress.

25. A patient positioning mattress comprising:

a mattress;

a guide coupled to the mattress and configured to progressively align a sheet along a length of the mattress, wherein the guide is configured to allow traversal of the sheet along the length of the mattress and concurrently retard motion of the sheet in at least two directions perpendicular to the length of the mattress, wherein the guide includes a first guide, a second guide, and a third guide; and, the first, second, and third guides are spaced apart from one another and extend along the length of the mattress.

26. A patient positioning device for an articulating bed comprising:

a mattress having at least two ends and being supported on the bed, wherein at least one end allows vertical and angular repositioning with respect to another end as the bed is articulated; and, a drive mechanism operatively coupled to the mattress and configured to reposition a sheet along a length of the mattress, the drive mechanism is positioned at least partially below a top surface of the mattress, wherein the drive system is configured to be repositioned when least one of the two ends of the mattress is repositioned.

27. The patient positioning device of claim 26, wherein the drive mechanism is at least partially positioned within a volume of the bed.

28. The patient positioning device of claim 26, wherein the drive mechanism is positioned within a volume of the bed.

29. A patient positioning device for a healthcare bed comprising:

a mattress having at least two ends, wherein at least one end allows vertical and angular repositioning with respect to another end; and, a drive mechanism operatively coupled to the mattress and bed and configured to reposition a sheet along a length of the mattress, the drive mechanism is positioned at least partially below a top surface of the mattress, wherein the drive system is configured to be repositioned when at least one of the two ends of the mattress is repositioned.

* * * * *

UNITED STATES PATENT AND TRADEMARK OFFICE

CERTIFICATE OF CORRECTION

PATENT NO. : 9,003,578 B2
APPLICATION NO. : 13/632561
DATED : April 14, 2015
INVENTOR(S) : Hillenbrand, II It is certified that error appears in the above-identified patent and that said Letters Patent is hereby corrected as shown below:

In the specification

Column 1, line 65, "... may include a plurality segments ..." should read --... may include a plurality of segments ...--.

Column 4, line 59-60, "This features may reduce ..." should read --This feature may reduce--.

Column 5, line 54, "... in at least in the general directions ..." should read --in at least the general directions--.

In the claims

Column 8, line 58, CLAIM 23 "... another an extend along the length of the mattress" should read --another and extend along the length of the mattress--.

Column 9, line 18, CLAIM 26 "... drive system is configured to be positioned when least ..." should read --drive mechanism is configured to be positioned when least--.

Column 10, line 16, CLAIM 29 "... drive system is configured to be positioned when at least ..." should read --drive mechanism is configured to be positioned when at least--.

Signed and Sealed this
Twenty-third Day of February, 2016

Michelle K. Lee

Michelle K. Lee
*Director of the United States Patent and Trademark Office*